United States Patent [19]

Wyant

[11] Patent Number: 4,991,767

[45] Date of Patent: Feb. 12, 1991

[54] PORTFOLIO WITH PHOTOGRAPH DISPLAYING COVER

[75] Inventor: Jon R. Wyant, Spring Valley, Ohio

[73] Assignee: The Mead Corporation, Dayton, Ohio

[21] Appl. No.: 379,306

[22] Filed: Jul. 13, 1989

[51] Int. Cl.[5] ..... B65D 27/04; B65D 27/08

[52] U.S. Cl. ..... 229/1.5 R; 40/159; 40/359; 281/31

[58] Field of Search ..... 229/1.5 R, 71, 72; 40/158.1, 159, 359, 649; 281/31

[56] References Cited

U.S. PATENT DOCUMENTS

| | | | |
|---|---|---|---|
| 720,324 | 2/1903 | Bushnell, Jr. | 229/1.5 R |
| 868,835 | 10/1907 | Bexell | 229/1.5 R |
| 1,086,341 | 2/1914 | Adler | 229/1.5 R |
| 1,320,683 | 11/1919 | Goodhue | 40/159 X |
| 2,088,672 | 8/1937 | Steinthal | 281/31 |
| 2,150,474 | 3/1939 | Williams | 281/31 |
| 2,253,814 | 8/1941 | Sames | 40/159 |
| 2,801,115 | 7/1957 | Federbush et al. | 281/31 |
| 3,870,223 | 3/1975 | Wyant | 229/1.5 R X |
| 4,164,085 | 8/1979 | Steeb et al. | 40/152 |
| 4,172,332 | 10/1979 | Holes et al. | 281/31 X |
| 4,301,962 | 11/1981 | Monckton et al. | 229/1.5 R X |
| 4,314,635 | 2/1982 | Fraser et al. | 281/31 X |
| 4,597,590 | 7/1986 | Papouchis | 281/34 |

FOREIGN PATENT DOCUMENTS

| | | | |
|---|---|---|---|
| 859358 | 12/1940 | France | 40/159 |
| 3717 | 2/1898 | United Kingdom | 229/72 |

*Primary Examiner*—Stephen Marcus
*Assistant Examiner*—Jes F. Pascua
*Attorney, Agent, or Firm*—Biebel, French & Nauman

[57] ABSTRACT

A portfolio comprising a front cover having cut-out sections, a rear cover hingedly connected to the front cover, and a transparent film overlaying the cut-out sections forming windows in the front cover. The front cover includes an inner front panel having openings corresponding to the cut-out sections forming pockets for displaying photographs through the corresponding windows.

6 Claims, 4 Drawing Sheets

PORTFOLIO WITH PHOTOGRAPH DISPLAYING COVER

BACKGROUND OF THE INVENTION

The present invention relates generally to portfolios, binders, and the like, and more particularly, to such a device having a cover with windows for displaying photographs or the like.

There has always been a desire among students to personalize their school portfolios, binders, and the like. One way to personalize such items is to provide a means for displaying a photograph, or the like on the portfolio's front cover. The terms "portfolio" and "binder" may be used interchangeably herein with the understanding that "binder" refers generically to hinged folders whether or not binder rings are provided.

Accordingly, it is desirable to have a low cost portfolio, or the like which can be personalized by displaying a photograph, or the like on its front cover. In addition, the photograph should be easily mounted and protected from general wear and tear.

SUMMARY OF THE INVENTION

The present invention provides a portfolio for displaying photographs through its front cover. The portfolio preferably is produced from a blank comprising an outer front panel, an inner front panel and a rear panel. These panels may be folded along fold lines to define front and rear covers for the portfolio. The outer front panel has at least one opening or cut-out which is covered by a transparent film to define a window. The inner front panel is adhesively secured to the outer front panel on an area surrounding the window to define a pocket for insertion of a photograph or the like. The inner front panel has an opening in the form of a notch which substantially matches a portion of the outline of the cut-out to provide an entry to the pocket. The front cover preferably has a plurality of such pockets for displaying photographs outwardly through the corresponding windows.

The primary object of this invention, therefore, is to provide a portfolio having a cover with pockets and transparent windows for displaying photographs.

Other objects and advantages of the invention will be apparent from the following description, the accompanying drawings and the appended claims.

DETAILED DESCRIPTION OF THE INVENTION

Figure 1:
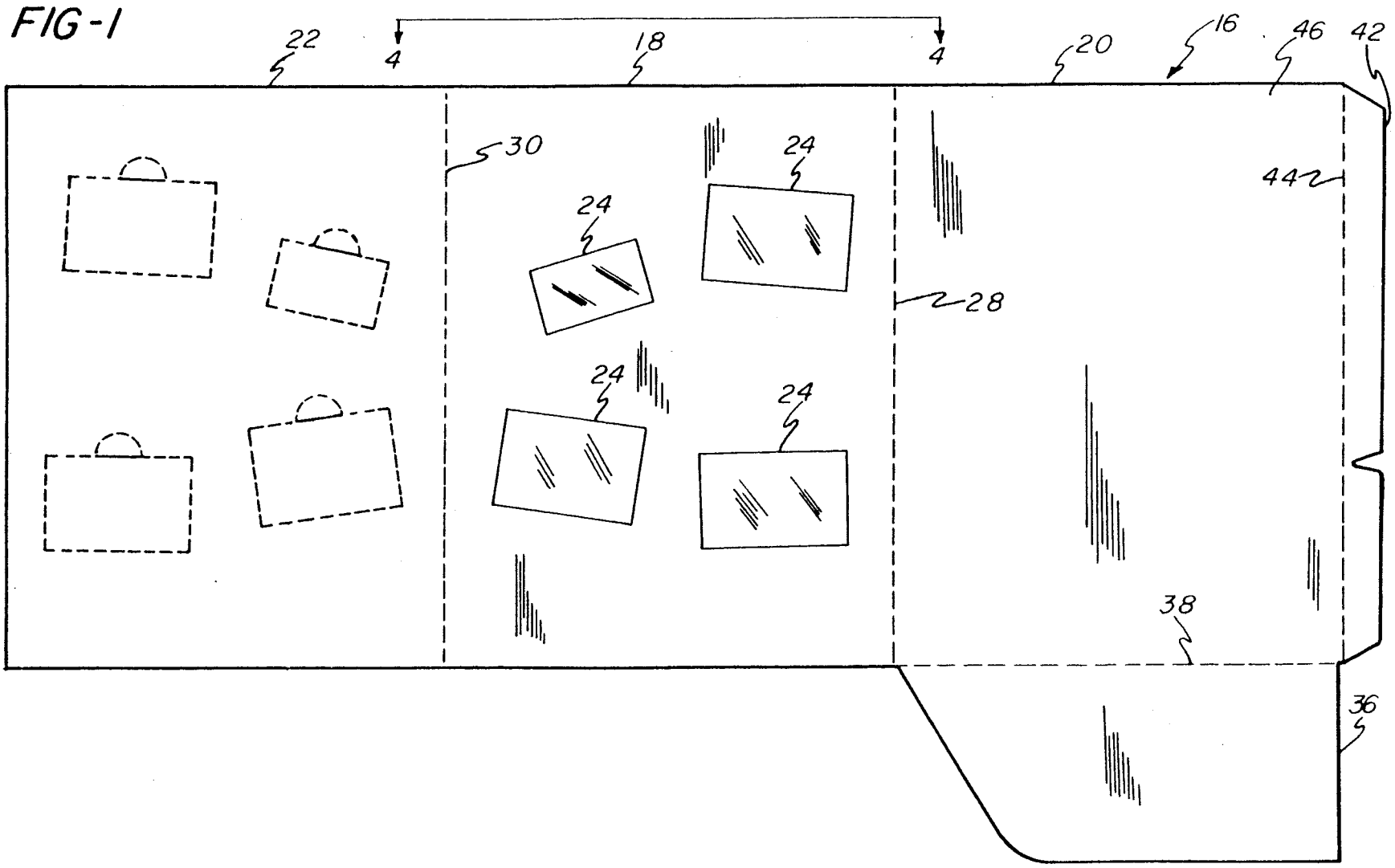
FIG. 1 is a front plan view showing a flat, partially assembled portfolio with photograph in accordance with the present invention.

Referring to the drawings in greater detail, a portfolio, generally designated 10, having a front cover 12 with transparent windows 14 for displaying photographs is shown in FIGS. 1 through 5.

Figure 2:
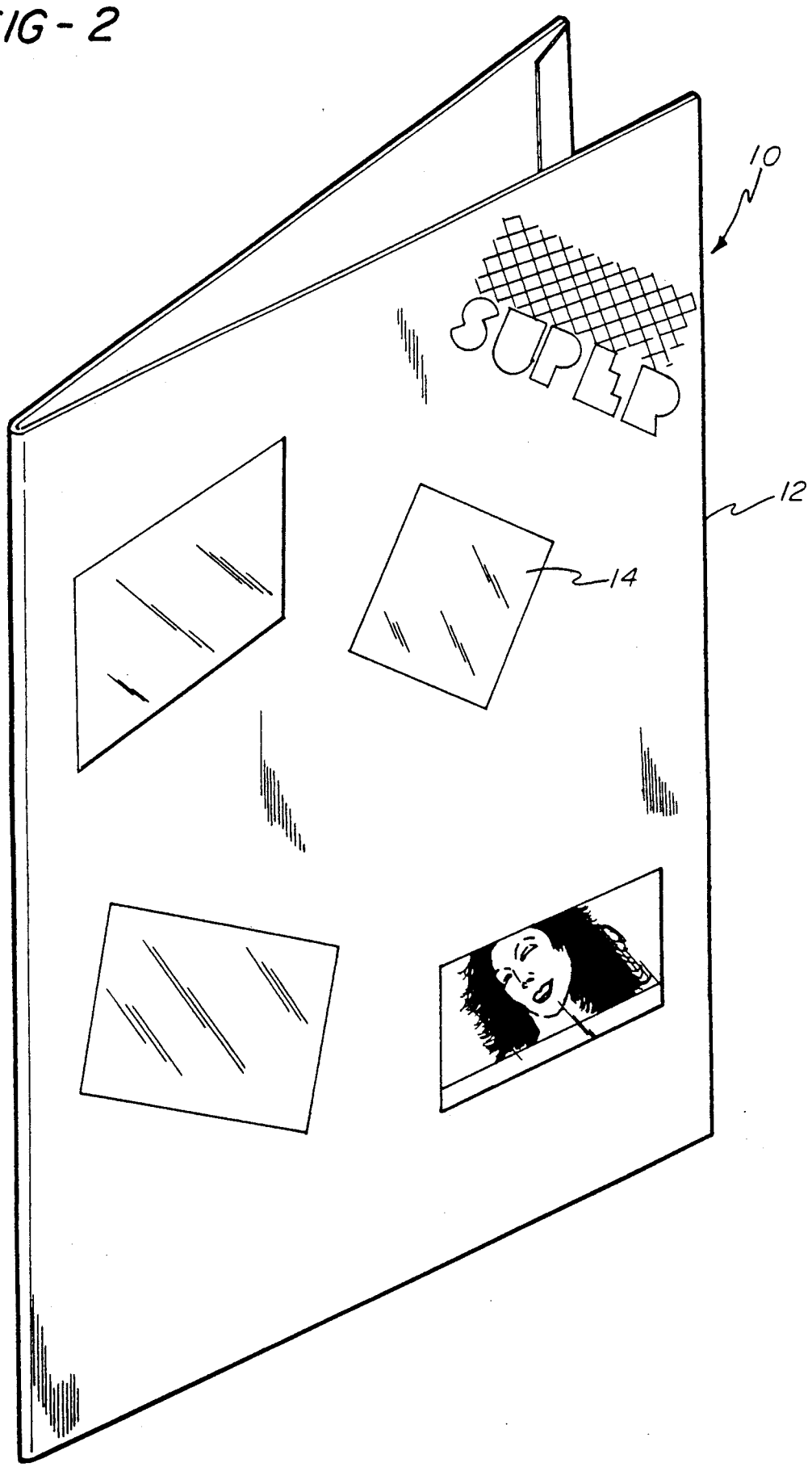
FIG. 2 is a front perspective view of the portfolio with photograph displaying cover constructed in accordance with the present invention and showing a photograph being inserted into a pocket with the image facing outwardly through a window.
Figure 4:
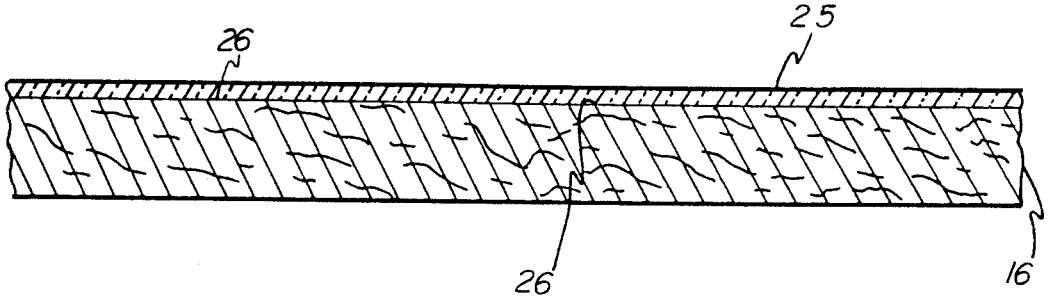
FIG. 4 is an enlarged partial side view of the portfolio blank showing the paperboard and the transparent plastic film layer.

The portfolio 10, as shown in FIGS. 1 , 2 and 4, is formed from a relatively flexible generally rectangular blank 16, which may be manufactured from paperboard, or the like, and comprises an outer front panel 18, a rear cover panel 20, and an inner front panel 22. The outer front panel 18 includes at least one generally rectangular in shape cut-out section 24. The blank 16 is covered by a transparent plastic film 25 which overlays the outer surface 26 of the panel 16 and each cut-out section 24. The overlaying transparent film 25 provides protection against water, dirt and the like, and provides the portfolio with a relatively smooth surface which can be easily slid between other portfolios, note books and tghe like. The appearance of the portfolio 10 can easily be varied by providing a variety of graphics on the outer surface 26 of the blank 16.

Figure 3:
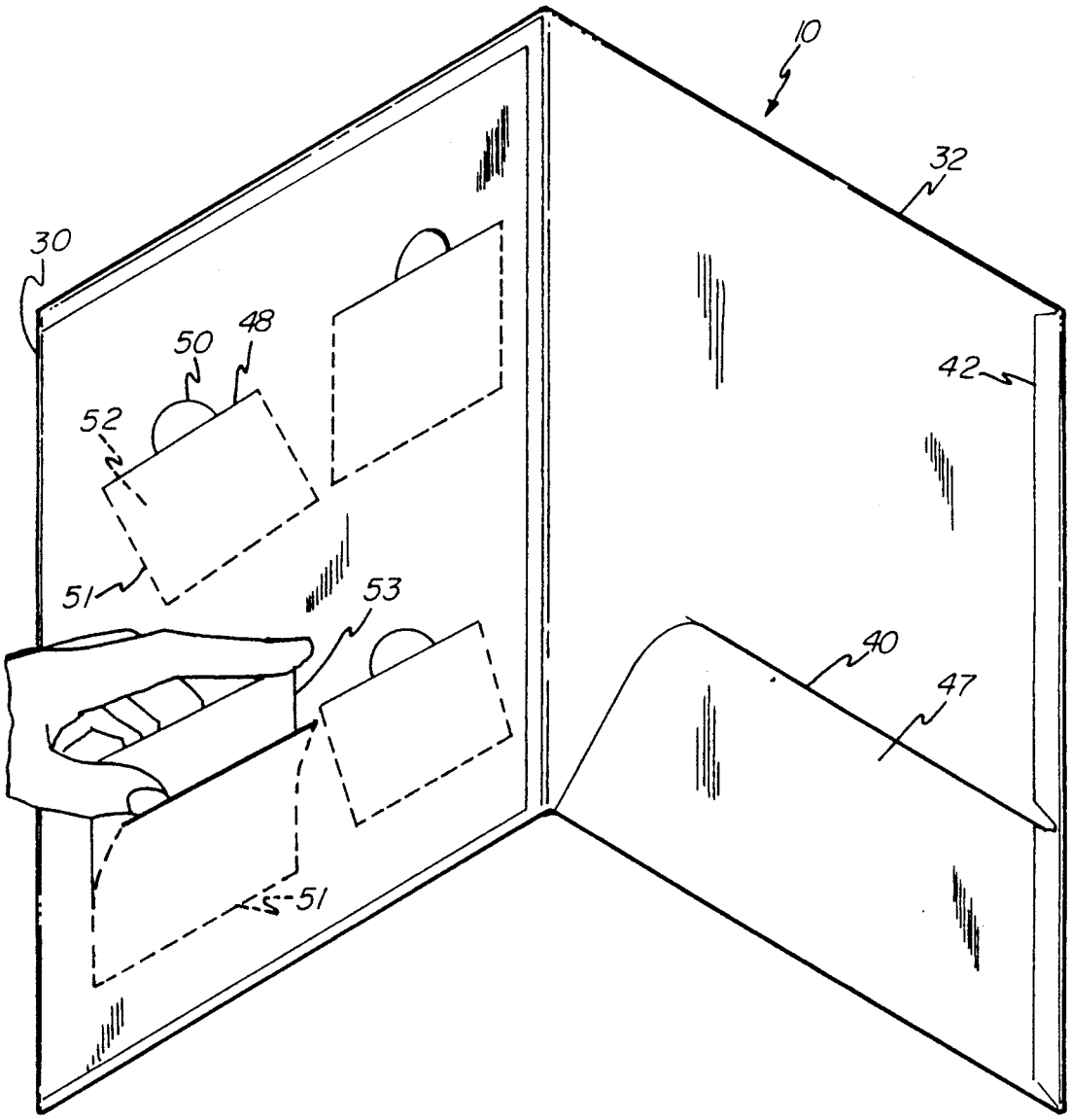
FIG. 3 is a perspective view of the portfolio showing the inner pocket and the inner front panel and showing the photograph being inserted into the pocket.

As shown in FIGS. 1 through 3, the outer front panel 18 and the inner front panel 22 are folded along a fold line 30 to form the front cover 12. Windows 14 are defined by cut-out portions 24 and the overlaid plastic film 25. Rear cover panel 20 is joined to outer front panel 18 along a fold line 28 to partially define a rear cover 32.

The blank 16 further comprises a short bottom flap 36 which is folded over the rear cover panel 20 along a fold line 38 to form an inner pocket 40 (FIG. 3) for securing paper sheets, note pads or the like (not shown).

The rear cover 32 is provided with a narrow marginal flap 42 which is folded along a fold line 44 and adhesively secured to the inner surface 46 of the rear cover 32 and the outer surface 47 of pocket 40 to add strength to the rear cover 32 and to hold the pocket forming portion 36 in folded position.

Referring to FIG. 3, the inner surface of front cover 30 is provided with slits 48 which substantially match one side of cut-out sections 24 in outer front panel 18. The inner front panel 22 is adhesively secured to the outer front panel 18 in the areas surrounding cut-outs 24 to form pockets 52. The pockets 52 are particularly sized to hold various sizes of photographs 53. As shown in FIG. 3, the inner surface of the front cover 30 is provided with graphical markings outlining the boundaries of each pocket 52 which can be used as a pattern to size the particular photograph or the like to be inserted.

Figure 5:
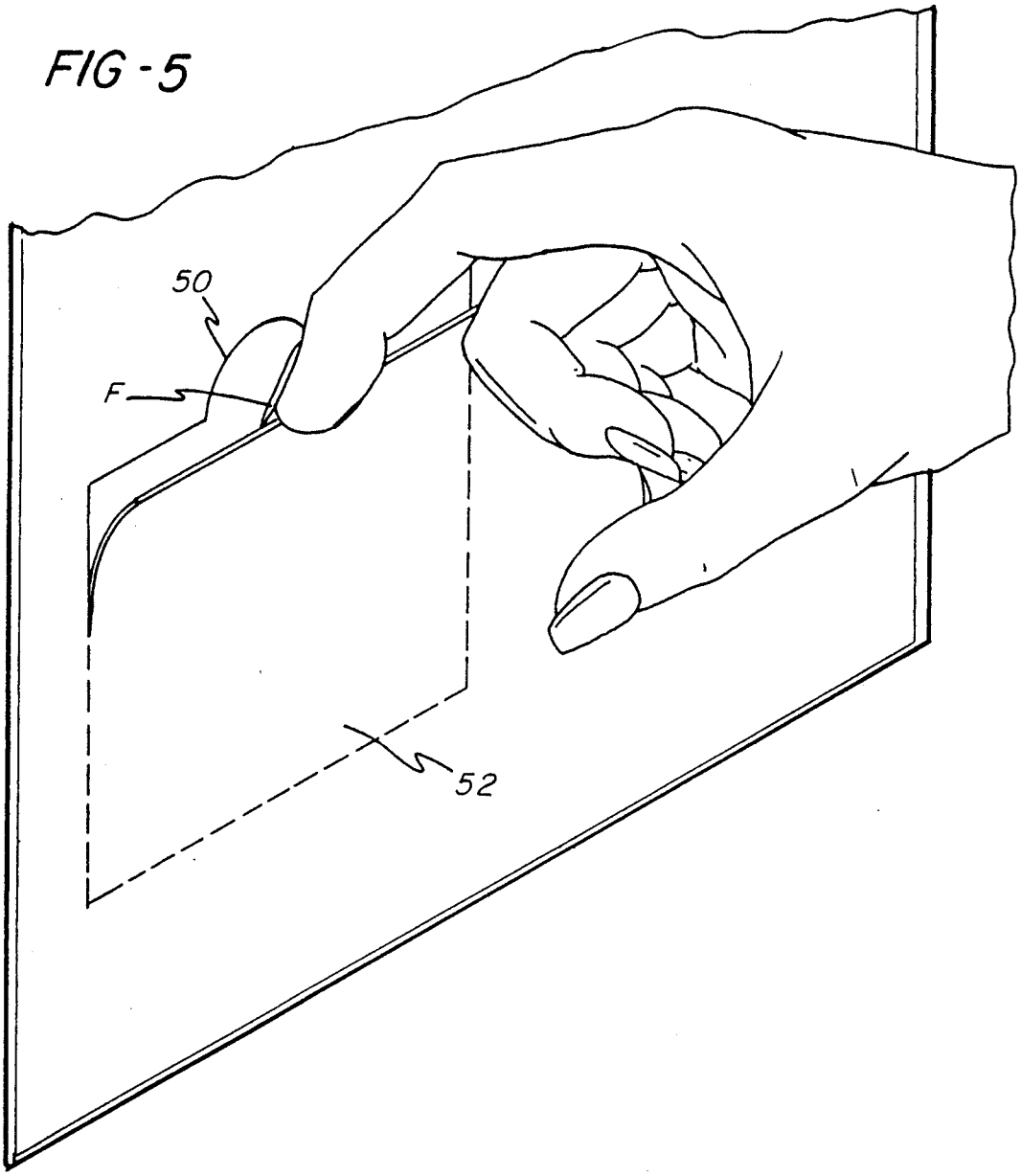
FIG. 5 is an enlarged partial perspective view of the portfolio showing the operation of gripping the notch.

As shown in FIGS. 3 and 5, each slot 48 has a corresponding generally semicircular gripping notch 50. It should be apparent that the user can open each pocket 52 by inserting a fingernail F into the corresponding gripping notch 50 to readily insert a photograph 53 through the slot 48 with the images facing outwardly for displaying through the corresponding window 14 in the front cover 30.

It should be apparent that the shape, size, number, and position of the pockets and windows can vary. It should also be apparent that the windows can be used for displaying other inserts such as business cards, advertising material, and the like.

While the form of the product herein described constitutes a preferred embodiment of this invention, it is to be understood that the invention is not limited to this precise form of product, and that changes may be made therein without departing from the scope of the invention which is defined in the appended claims.

What is claimed is:

1. A portfolio comprising a front cover and a rear cover hingedly attached to said front cover, characterized in that said front cover comprises:

an outer front panel provided with a plurality of spaced generally rectangular openings;

a transparent film overlaying said openings to define a plurality of windows; and, an inner front panel secured against said outer front panel in areas surrounding each of said windows to define a plurality of insert receiving pockets; said inner front panel being provided with slits substantially matching one side of each of said openings for enabling insertion of photographs or the like into said pockets.

2. A portfolio according to claim 1 wherein said inner front panel is provided with a plurality of notches adjoining said slits for affording easy entry into said pockets.

3. A portfolio according to claim 2 wherein said rectangular openings are disposed with relative angularity to provide an enhanced decorative effect.

4. A portfolio according to claim 3 wherein said inner front panel is hingedly joined to said outer front panel.

5. A portfolio according to claim 4 characterized in that said rear cover comprises a rear cover panel and a flap folded inwardly and upwardly from the bottom of said rear cover panel; said flap being secured against the inside surface of said rear cover panel to define a pocket for receiving loose sheets.

6. A portfolio according to claim 5 wherein said notches have a generally semi-circular configuration.

* * * * *